United States Patent [19]

Leebeek et al.

[11] Patent Number: 4,944,165

[45] Date of Patent: Jul. 31, 1990

[54] DEVICE FOR THE WASHING OF FABRIC BY MACHINE

[75] Inventors: Antonius C. G. Leebeek, Brussels; James P. Johnston, Overijse, both of Belgium

[73] Assignee: The Procter & Gamble Company, Cincinnati, Ohio

[21] Appl. No.: 309,448

[22] Filed: Feb. 10, 1989

[30] Foreign Application Priority Data

Feb. 11, 1988 [FR] France ..... 88 01658

[51] Int. Cl.[5] ..... D06F 39/02

[52] U.S. Cl. ..... 68/17 R; 206/0.5; 252/90; 252/95

[58] Field of Search ..... 8/137, 158, 159; 68/17 R, 17 A, 235 R; 252/90, 92, 95; 206/0.5, 216; 222/158, 478

[56] References Cited

U.S. PATENT DOCUMENTS

| | | | |
|---|---|---|---|
| 3,937,042 | 2/1976 | Loeb | 68/17 A X |
| 4,588,080 | 5/1986 | Ginn | 206/219 |
| 4,835,804 | 6/1989 | Arnau-Munoz et al. | 68/17 R X |

FOREIGN PATENT DOCUMENTS 1307387 2/1973 United Kingdom .

*Primary Examiner*—Philip R. Coe

*Attorney, Agent, or Firm*—Michael E. Hilton; R. C. Witte; John V. Gorman

[57] ABSTRACT

Device for washing of fabric by machine having at least one filling orifice and ports for progressively releasing a liquid detergent into the fabric during washing. At least one solid product including additive ingredients useful for washing is located outside the main body of the device. These additive ingredients are likewise released progressively during washing. The solid product preferably comprises sodium perborate.

9 Claims, 2 Drawing Sheets

DEVICE FOR THE WASHING OF FABRIC BY MACHINE

TECHNICAL FIELD

The present invention relates to the washing and cleaning of fabrics by machine and, more particularly, to a device for releasing both liquid and solid constituents of a washing agent into the wash.

BACKGROUND INFORMATION

A process which greatly improves the efficiency of washing fabric by machine with a liquid detergent is described in European Patent Application No. 85 40 06 52.5, published under number 0,151,549. According to this process, a device containing a liquid detergent and having ports is placed in the drum of the washing machine together with the fabric to be washed. The detergent progressively enters the fabric and the washing bath through ports as soon as the machine is started. According to one embodiment, a predetermined quantity of liquid detergent is poured into the device through a filling orifice, and at the end of washing, the device is recovered for reuse. This process is in widespread use in Europe and has enjoyed great commercial success.

Devices have been developed making it possible to carry out the above-mentioned process. For example, U.S. Pat. No. 4,703,872 issued Nov. 3, 1987 to Cornette et al., discloses a device having at least one filling orifice and ports for releasing the liquid progressively into the fabric during washing. The device comprises a body and an attached assembly which is intended for the filling and/or diffusion of the liquid. This assembly can be mounted permanently on the body or, instead, can be removable. Such an assembly can have a central filling orifice and ports distributed over its periphery. According to an advantageous embodiment, the filling orifice has the form of a shaft penetrating into the body. The device preferably has an essentially spherical shape. This shape is, nevertheless, in no way limiting.

A technical problem which arises with regard to liquid detergent compositions is the mutual incompatibility of some constituents of the composition with others. This is true, for example, for liquid detergent formulations and bleaching constituents, intended for releasing active chlorine or oxygen. In these situations a reaction beneficial to cleaning occurs upon mixing. If the constituents are mixed and shipped together, the reaction occurs within the container rather than in the wash. This is especially true for peroxygenated constituents based on perborates. It is impossible to allow a perborate-based bleaching agent to come into contact with a liquid detergent composition, otherwise there is the risk of a prior reaction causing the peroxygenated compound to lose all its effectiveness.

The subject of the present invention is an especially simple and elegant arrangement of a device for the washing of fabric by machine, which particularly makes it possible to carry out the washing process with detergent constituents which are not satisfactorily compatible with one another.

The device according to the present invention is intended more particularly for the packaging of liquid detergent ingredients, while at the same time making it possible to achieve a separate presentation of other constituents having a specific action, the said other constituents being put in solid form. A person skilled in the art will understand that the device of the invention is designed to allow the packaging of a liquid detergent formulation and at least one other solid product, the properties of which are such that they contribute to the washing by performing their specific function, most advantageously at predetermined moments in the cycle.

SUMMARY OF THE INVENTION

Thus, the invention relates to a device for the washing of fabric by machine, having a main body with a filling orifice and ports for releasing a liquid detergent progressively into the fabric during washing. The device also has a means for locating at least one solid product including additive ingredients useful for washing external to the main body, the solid product likewise being released progressively during washing.

Within the meaning of the present description, the expression "solid product including additive ingredients useful for washing" means a product of essentially solid physical form, the additive ingredients which it contains being solid in themselves or being presented within a formulation having such a solid form. Of course, the effect of such a solid product, when it is in contact with the washing bath, must be to release the ingredients or constituents which it contains and to allow them to perform their specific function during the washing process. As an example, water-soluble tablets or pellets based on sodium perborate are already known in the art. Such a constituent exerts a favorable removing effect on the so called "oxidizable" stains.

A preferred embodiment of the invention is a device in which the solid product is based on perborate. However, other alternative embodiments can comprise solid formulations containing various specific constituents, such as enzymes, which can then be incorporated in a solid formulation soluble in water, for example based on sodium bicarbonate and citric acid. Such an "effervescent formulation ensures rapid dissolving and effective diffusion of the active agents. Other agents which can be added in a solid composition can also be used, for example stain-suspending agents, such as zeolites or polyacrylates.

It can also be seen that the solid product equipping the device according to the invention can comprise various ingredients or constituents having a specific function in the washing, in as much as they can have satisfactory compatibility with one another. Examples of these will be given in the following description, for peroxygenated agents, especially based on sodium perborate, and agents further improving the bleaching and giving the fabric a higher "luster", for example, optical brighteners.

BRIEF DESCRIPTION OF THE DRAWINGS

The invention will also be illustrated, without being limited in any way, by the following description made with reference to the accompanying drawings in which.

DESCRIPTION OF THE PREFERRED EMBODIMENT

Figure 3:
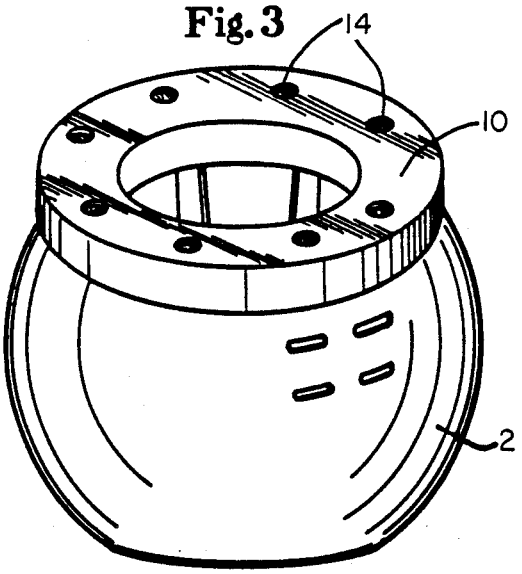
FIG. 3 shows a device according to the invention in perspective.
Figure 2:
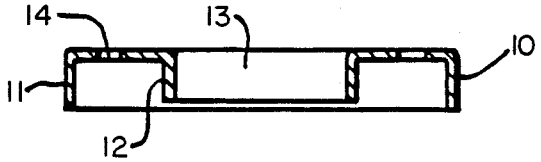
FIG. 2 is an axial section through the retaining cap of the device of the present invention.
Figure 1:
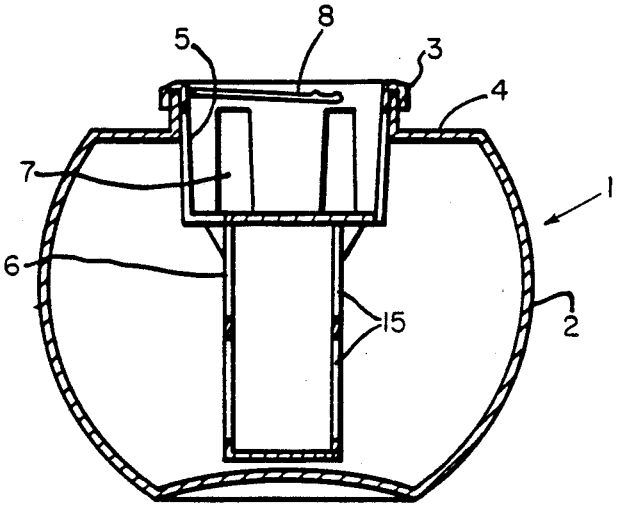
FIG. 1 is a view in axial section of the main body of the device of the present invention.

The device according to the present invention, comprises a cap 10 illustrated in FIG. 2 and a main body, illustrated in FIG. 1 and designated generally as 1. The main body 1 has the form of a generally spherical body of revolution in the chosen example. However, any other form, for example a cylindrical form, could also be adopted. The structure of the main body 1 is somewhat similar to that of the device forming the subject of the aforesaid U.S. Pat. No. 4,703,872. The main body 1 includes a component body 2 and a centrally located assembly 3 comprising a bowl-shaped part 5 connected to a cylindrical shaft 6 penetrating into the component body 2. The apertures 7 in the bowl-shaped part 5 serve both for the filling and for the diffusion of the liquid detergent composition, as will be explained later. The cylindrical shaft 6 also has longitudinal apertures 15 intended to make the filling operation easier. The spherical component body 2 joins the assembly 3 via a radial surface 4, the function of which will be described below. Furthermore, the bowl-shaped part 5 is equipped with a thread 8.

The main body 1 of the preferred embodiment, is intended for receiving a liquid detergent composition which is discharged through the bowl-shaped part 5 of the assembly 3.

Figure 4:
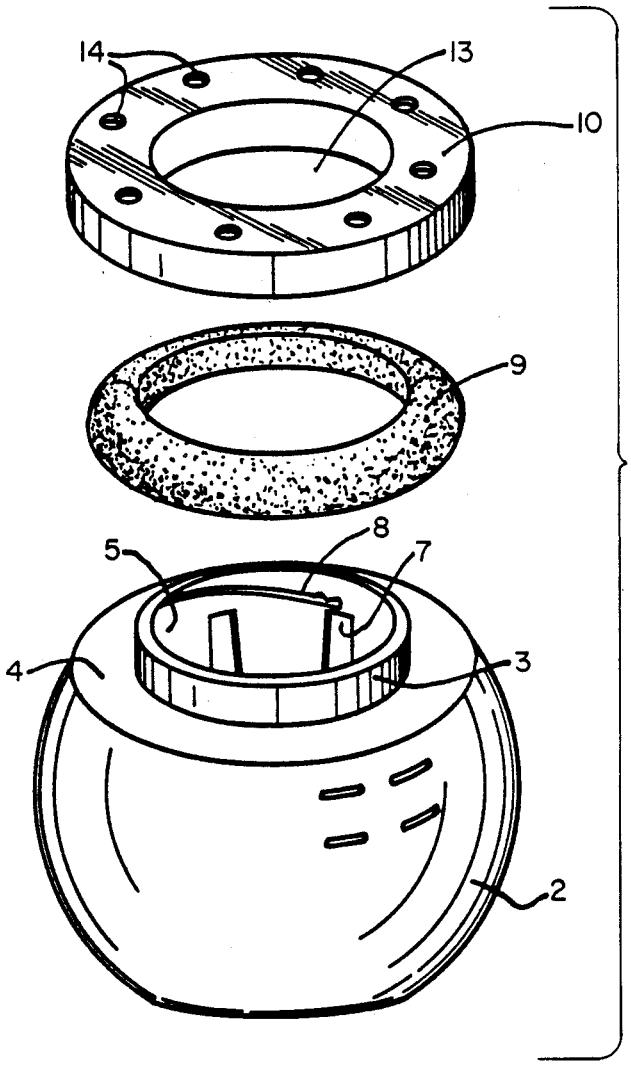
FIG. 4 is an exploded view of the device of FIG. 1.

Referring to FIG. 4, the device also accommodates solid product 9 in the form of a ring or collar of circular, elliptic or other cross-section, which surrounds the zone of the bowl-shaped part 5 and which is laid against the radial surface 4. The cap 10 is intended for retaining the solid product ring 9 on the main body 1. A cap 10, shown in section in FIG. 2, comprises an outer wall 11 and an inner wall 12, between which is formed a space which allows the solid product ring 9 to be inserted. The circular wall 12 delimits a central orifice 13 on the inside. The cap 10 is provided with apertures 14. The wall 12 is likewise equipped with a thread matching the above-mentioned thread 8.

The device is very simple to assemble: in order to retain the solid product 9 on the surface 4 around the diffuser assembly 3, it is sufficient, after the ring 9 has been put in place, to apply the cap 10 and screw it to the bowl-shaped part 5.

The accompanying drawings illustrate one preferred embodiment of the invention; however, these particulars are given only as an illustration. For example, the means for retaining the solid product could be other than a cap. If a cap is used the means for securing the removable cap 10 to the body 2 or the attached assembly 3 respectively could be different from the screwing means 8. Fastening by a matching of shapes could also be used. It could also be possible to mount several caps 10 superposed, in order to provide receptacles intended for receiving different solid products.

The device of FIGS. 1 to 4, is highly suitable for the packaging of a liquid detergent composition inside the component body 2 with a solid product 9, external the component body 2, for example based on a peroxygenated compound, such as sodium perborate. A person skilled in the art knows that peroxygenated bleaching agents can be put in solid form by compacting, and in the device according to the invention the adopted form is that of a ring 9 surrounding the central filling orifice 13 of the device.

It can therefore be seen that the device according to the invention makes it possible to separate the peroxygenated compound, especially sodium perborate, from the basic liquid detergent composition. This characteristic is highly advantageous, and many attempts have been made, unsuccessfully or with excessively complicated means, to obtain the same result. The present invention, however, achieves it in a simple and effective way.

It will be seen that the device according to the invention can be used with solid products containing very varied active constituents or ingredients. These can be solid as a result of their physical properties or can be incorporated in a formulation having such a water-soluble solid structure. For example, instead of a peroxygenated compound, such as sodium perborate, the ring of solid product 9 could consist of a solid matrix containing enzymes, softeners, bleaching activators, bleaching catalysts, optical brighteners, stain-suspending agents, such as zeolites or polyacrylate, agents exerting an action to remove grease stains or other additives exerting a specific action during washing.

It is possible to use the device with a ring-shaped product 9 presented separately, and this makes it possible to carry out washing to choice, because the product 9 is either used or not, depending on the state of the stains. If the user wishes to employ this product for its specific function in the washing, it is sufficient for him to place it on the surface 4 and then screw the cap 10 to the main body 1, the latter having been filled with liquid detergent previously or not. The device is then placed in the drum of the machine together with the fabric to be washed, and the washing cycle is allowed to proceed. The liquid detergent diffuses progressively through the apertures 7, while the solid product 9 dissolves progressively under the influence of the washing bath, in order to allow the active ingredients to diffuse through the holes 14.

In another embodiment, not shown, the device can be equipped beforehand with a solid product 9, in which case the cap 10 is already irremovably fastened to the main body 1. The product 9 is thus retained and protected from external agents by the cap 10, and this also makes it possible to prevent any handling by the user. This may be advantageous if the active ingredients of the product 9 are somewhat reactive or aggressive substances as where concentrated perborates are concerned. It is then sufficient to fill the body 2 with the desired quantity of liquid detergent composition, after which the device is used for washing in the same way as before.

Actual examples of a liquid detergent composition and a solid product which can be incorporated in the device according to the invention are given below.

EXAMPLE 1

| | % |
|---|---|
| Liquid detergent composition | |
| Alkyl (linear $C_{12}$–$C_{18}$) benzene sulphonic acid | 13.25 |
| $C_{12-18}$ fatty alcohol with 7 moles of ethylene oxide per mole of alcohol | 8 |
| Sodium $C_{12}$–$C_{14}$ alcohol sulphate | 2.14 |
| Alkenyl ($C_{12}$–$C_{14}$) succinic acid | 12.50 |
| Oleic acid | 1.8 |
| Citric acid | 3 |
| Diethylene triaminepentamethylenephosphonic acid | 0.7 |
| NaOH | 7 |
| Ethanol | 2 |

-continued

| | % |
|---|---|
| Propanediol | 5 |
| Sodium formate | 0.7 |
| Protease | 0.47 |
| Amylase | 0.85 |
| Polymer for releasing stains (alcoxylated ester of phthalic acid) | 0.48 |
| Water and various minor constituents | 42.11 |
| Solid Product | |
| Tetraacetylethylenediamine | 9.5 |
| Sodium perborate, $1H_2O$ | 56 |
| Sodium bicarbonate | 13 |
| Tartaric acid | 12 |
| Optical brightener | 0.5 |
| Maleic/acrylic copolymer | 0.9 |
| Secondary agents | 8.1 |

180 g of the above mentioned liquid detergent composition and 37.75 g of the above-mentioned solid product is introduced into a device of the type illustrated in FIGS. 1 to 4. The washing of fabric by machine with a dose of this form gives excellent results as regards the action of the detergent and of the solid bleaching agent. The fabric samples washed in this way have a whiteness and luster greater than those of control samples washed under the same conditions and with the same quantity of liquid composition, but without the solid product being used.

EXAMPLE 2

| | % |
|---|---|
| Liquid detergent composition | |
| Alkyl (linear $C_{12}$–$C_{18}$) benzene sulphonic acid | 13.25 |
| $C_{12}$–$C_{18}$ fatty alcohol with 7 moles of ethylene oxide per mole of alcohol | 8 |
| Sodium $C_{12}$–$C_{14}$ alcohol sulphate | 2.14 |
| Alkenyl ($C_{12}$–$C_{14}$) succinic acid | 12.50 |
| Oleic acid | 1.8 |
| Citric acid | 3 |
| Diethylene triamine pentamethylenephosphonic acid | 0.73 |
| NaOH | 7 |
| Ethanol | 2 |
| Propanediol | 5 |
| Sodium formate | 0.7 |
| Protease | 0.47 |
| Amylase | 0.85 |
| Polymer for releasing stains (alcoxylated ester of phthalic acid) | 0.48 |
| Water and various minor constituents | 42.08 |
| Solid product | |
| Tetraacetylethylenediamine | 9.5 |
| Sodium perborate, $1H_2O$ | 56 |
| Sodium bicarbonate | 18 |
| Tartaric acid | 12 |
| Optical brightener | 0.5 |
| Maleic/acrylic copolymer | 0.9 |
| Secondary agents | 3.1 |

In a device illustrated in FIG. 1 to 4, 180 g of the above liquid detergent composition, introduced inside the body of the device, and 37.75 g of the above solid product is used. Excellent results for washing fabric by machine are obtained, the washed samples have a whiteness and a luster greater than those of control samples which are washed under the same conditions, but only with a liquid detergent composition.

In the above-mentioned examples, all the parts have been given by weight.

It is, of course, to be understood that the present invention is by no means limited to the particular arrangement shown in the drawings nor by the preceding examples but also comprises any modification within the scope of the appended claims.

What we claim is:

1. A device for releasing liquid and solid constituents of a washing agent into a washing bath including a main body interrupted by a filling orifice and a port for progressively releasing liquid detergent from within said main body into the fabric during washing, wherein the improvement comprises: a solid product including soluble additive ingredients useful for washing and a means for supporting and retaining said solid product on the exterior of said main body as said additive ingredient dissolves during washing.

2. A device for releasing liquid and solid constituents of a washing agent into a washing bath including a main body whose general shape is the form of a body of revolution, said main body being interrupted by a filling orifice centrally located within said main body, and diffusion ports distributed around said orifice, wherein the improvement comprises: a solid product including additive ingredients useful for washing, and a means for locating said solid product against the outer surface of said main body around the zone of said orifice and said ports.

3. A device for releasing liquid and solid constituents of a washing agent into a washing body comprising: a main body, said main body further comprising a component body whose shape is in the form of a spherical body of revolution and an assembly attached thereto, said assembly being interrupted by a filling orifice and a port, said component body having a radial surface on which said assembly bears; and a solid product including additive ingredients useful for washing located externally to said main body in the zone of said radial surface surrounding said assembly.

4. A device according to claim 2 or claim 3, wherein said solid product has a generally annular shape.

5. A device according to claim 1, claim 2, or claim 3, wherein said solid product is located external to said main body by a cap, itself fixed removably to said main body, said cap further comprising holes for the progressive release of said additive ingredients of said solid product.

6. A device according to claim 1, claim 2, or claim 3, wherein said additive ingredients contained in said solid product are presented within a formulation having a solid form.

7. A device according to claim 1, claim 2, or claim 3, wherein at least one of said additive ingredients comprising said solid product including additive ingredients useful for washing is selected from the group consisting of enzymes, softeners, peroxygenated compounds, bleaching activators, bleaching catalysts, optical brighteners, stain-suspending agents, and agents exerting an action to remove grease stains.

8. A device according to claim 1, claim 2, or claim 3, wherein said solid product is sodium perborate.

9. A device according to claim 1, claim 2, or claim 3, wherein said active ingredients of the solid product are incorporated in a water-soluble composition.

* * * * *

UNITED STATES PATENT AND TRADEMARK OFFICE

CERTIFICATE OF CORRECTION

PATENT NO. : 4,944,165

DATED : July 31, 1990

INVENTOR(S) : Antonius C. G. Leebeek
James P. Johnston

It is certified that error appears in the above-identified patent and that said Letters Patent is hereby corrected as shown below:

Column 6, line 31, delete "body" and insert therefor --bath--.

Signed and Sealed this

Twenty-eighth Day of July, 1992

*Attest:*

DOUGLAS B. COMER

*Attesting Officer*

*Acting Commissioner of Patents and Trademarks*